United States Patent [19]

Gauslow

[11] 3,977,336

[45] Aug. 31, 1976

[54] MOTORIZED RUG HOOKING NEEDLE

[75] Inventor: Leone K. Gauslow, Moorehead, Minn.

[73] Assignee: Lawrence Peska Associates, Inc., New York, N.Y. ; a part interest

[22] Filed: Nov. 11, 1975

[21] Appl. No.: 630,934

[52] U.S. Cl. ..... 112/80

[51] Int. Cl.[2] ..... D05C 15/06

[58] Field of Search ..... 112/80, 79 R, 78, 79.5

[56] References Cited

UNITED STATES PATENTS

| | | | |
|---|---|---|---|
| 1,605,711 | 11/1926 | Garrett | 112/80 |
| 2,057,920 | 10/1936 | Rose | 112/80 |
| 2,887,076 | 5/1959 | Sterner | 112/80 |
| 3,142,276 | 7/1964 | Schauer | 112/80 |
| 3,714,915 | 2/1973 | Montell et al. | 112/80 |
| 3,867,888 | 2/1975 | Morissette | 112/80 |

*Primary Examiner*—H. Hampton Hunter
*Attorney, Agent, or Firm*—Erwin S. Teltscher

[57] ABSTRACT

In a hooking needle which includes an elongated bar which has a handle attached to one end, a needle fixed to the opposite forward end of the bar, and where the needle defines an open-ended enclosure having a yarn-receiving passage and a looper-receiving passage which extends longitudinally through the open-ended enclosure, and where the needle includes a fabric-penetrating portion in the longitudinal axis of the bar, a shuttle member mounted for reciprocating movement of the bar, a looper member having one end attached to the shuttle member and the opposite end slidably received through the needle member, a presser member slidably mounted on the elongated bar and extending longitudinally thereof, means for adjusting the relative position of the presser member to the bar and to the shuttle member to thereby vary the relative position of the forward end of the presser member to the forward end of the looper member, a coupling member in abutting engagement with the presser member, and releasable fastening means for fixing the coupling member to the rear portion of the presser member, the improvement includes a shaft-receiving member formed with a circular opening associated with the bar, a motor with a shaft, the shaft passing through the opening of the shaft-receiving member and being rotatable therein, at least one crankshaft, one end of which is eccentrically pivoted on the motor, and at least one bracket attached to the shuttle member, the other end of the crankshaft being pivoted on the bracket, so that upon rotation of the motor the shuttle member performs a reciprocating movement between the handle and the needle member.

6 Claims, 7 Drawing Figures

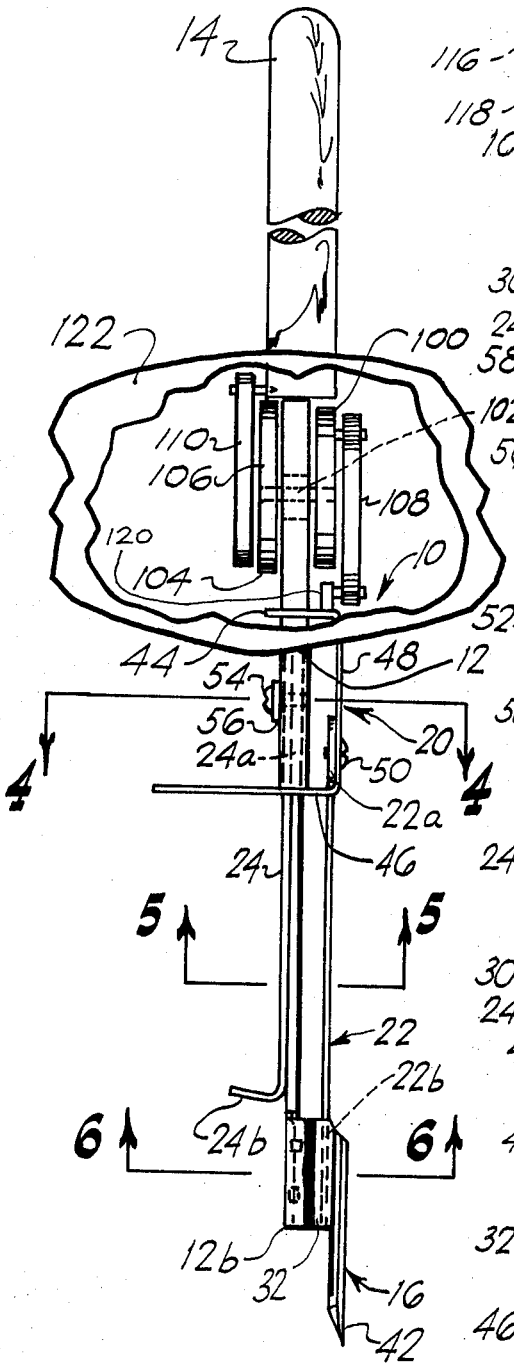
FIG. 1
FIG. 7
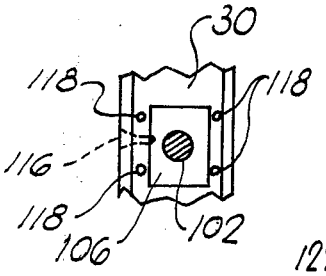
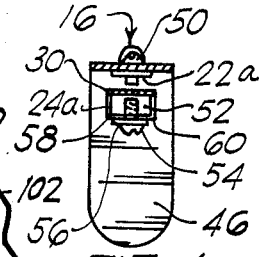
FIG. 4
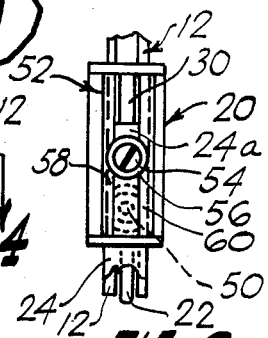
FIG. 2
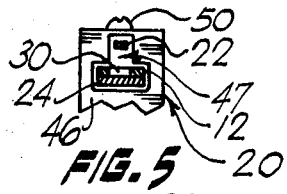
FIG. 5
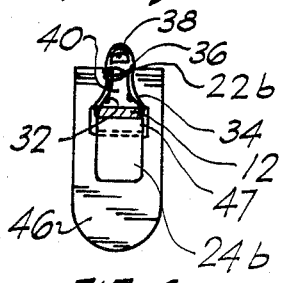
FIG. 6
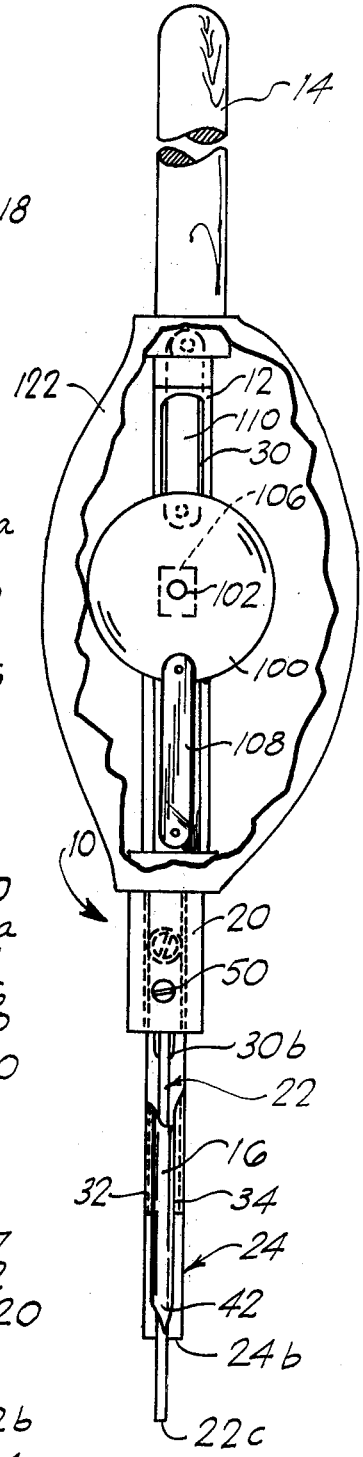
FIG. 3

MOTORIZED RUG HOOKING NEEDLE

BACKGROUND OF THE INVENTION

1. Field of the Invention

This type of hooking needle is well known and may be found described, for example, in U.S. Pat. Nos. 1,605,711 and 1,941,346 issued to J. E. Garett, respectively, on Nov. 2, 1926 and Dec. 26, 1933 and more recently in U.S. Pat. Nos. 3,714,915 issued on Feb. 6, 1973 to J. J. Montell et al, and 3,867,888 issued on Feb. 25, 1975 to B. Morissette.

2. Description of the Prior Art

In all the aforesaid patents the reciprocating motion of the shuttle member between the handle and the needle member is performed manually. Means have therefore been sought to substitute automatic motor-actuated motion for the manual motion referred to above, without the automatic motion means occupying an excessive space and therefore making the hooking needle unwieldy to handle.

SUMMARY OF THE INVENTION

It is therefore an object of the present invention to provide motorized means which will execute the reciprocating motion between the handle and the needle member. Accordingly, in a hooking needle including an elongated bar having a handle at one end thereof, a needle member fixed to the opposite forward end of the bar, the needle member defining an open-ended enclosure having a yarn-receiving passage and a looper-receiving passage extending longitudinally therethrough, the needle member including a fabric-penetrating portion frontwardly extending in the longitudinal axis of the bar, a shuttle member mounted to the bar for reciprocating movement thereon between the handle and the needle member, an elongated looper member having one end attached to the shuttle member and the opposite forward end slidably received in the looper-receiving passage of the needle member, a presser member slidably mounted on the elongated bar and extending longitudinally thereof, the presser member having a forward portion adapted to rest against the fabric to be hooked, means for adjusting the relative position of the presser member to the bar and to the shuttle member to thereby vary the relative position of the forward end of the presser member to the forward end of the looper member, a coupling member in abutting engagement with the presser member adjacent the rear end thereof, and releasable fastening means for fixing the coupling member to the rear portion of the presser member, I provide an improvement including a shaft-receiving member formed with a circular opening associated with the bar, a motor having a shaft attached thereto, the shaft passing through the opening in the shaft-receiving member, and being rotatable therein, at least one crankshaft having one end thereof eccentrically pivoted on the motor, and at least one bracket attached to the shuttle member, the other end of the crankshaft bein pivoted on the bracket, whereby the shuttle member performs a reciprocating movement between the handle and the needle member upon rotation of the motor.

In one embodiment of my invention the shaft-receiving member is rigidly attached to the bar.

It is advantageous if the elongated bar is formed with an elongated slot disposed in an intermediate portion of the bar between the handle and the needle member, so that the shaft-receiving member is slidable within the elongated slot.

It is also advantageous if a counterweight is attached to the shaft, the motor and the counterweight then being disposed on respective opposite side of the bar, and a second crankshaft is pivoted with one end on the counterweight, the other end of the second crankshaft being pivoted on the handle.

It is further advantageous if ball bearings are provided which are interposed between the shaft-receiving member and the bar to facilitate sliding of the shaft-receiving member within the slot. It is finally advantageous if an elastic protective cover is attached to the bar and to the handle which surrounds at least the motor and the crankshaft for protection of the operator.

BRIEF DESCRIPTION OF THE DRAWING

FIG. 1 is an elevational view of the hooking needle;

FIG. 2 is a bottom view of the hooking needle;

FIG. 3 is a plan view of the hooking needle illustrated in FIG. 1 in a different operating position;

FIG. 4 is a cross-sectional view taken along lines 4—4 of FIG. 1;

FIG. 5 is a cross-sectional view taken along lines 5—5 of FIG. 1;

FIG. 6 is a cross-sectional view taken along lines 6—6 of FIG. 1;

FIG. 7 is an enlarged plan view of FIG. 3 with portions of the motorized reciprocation means removed.

DESCRIPTION OF THE PREFERRED EMBODIMENT

In these drawings illustrating a preferred embodiment of the invention, there is shown a hooking needle generally designated by reference numeral 10. The needle comprises an elongated bar member 12 having at one end **12*a* thereof a handle 14, and at the other end 12*b* thereof a needle member 16. The needle 10 further includes a shuttle member 20 mounted to the bar 12 for reciprocating movement thereon between the handle and the needle member. An elongated looper member 22 has one end 22*a* attached to the shuttle member 20 and the other end 22*b* slidably received in the needle member 16.**

In accordance with the present invention, the needle 10 further includes an adjustable presser member 24 which has one end **24*a*, received within the shuttle member 20 and suitably mounted to the bar 12 and a frontward end 24*b*** which has a downwardly projection adapted to contact the fabric base to be worked.

The bar 12 is an elongated member made of rigid material, the rear end **12*a* of which is fixedly received in a correspondingly-shaped opening provided in the handle 14. The front end 12*b* of the bar has one end of its side edges a recess to receive therein in a fixed manner, such as by welding, the lower ends of the side walls of the needle member 16. The intermediate portion of the bar 12 includes an elongated slot 30,** the function which will hereinafter be described.

The needle member 16 is an open-ended enclosure with opposite side walls 32 and 34 to which is internally fixed an intermediate partition 36 (see FIG. 6) defining in the enclosure an upper yarn-receiving passageway 38 and a lower looper-receiving passageway 40. The needle member 16 terminates with a pointed fabric-penetrating portion 42 projecting frontwardly in the longitudinal direction of the bar 12.

Shuttle member 20 is a metal member which includes a short rear leg portion 44 and a long front leg portion 46 inter-connected by a web portion 48 extending over the bar 12. The short leg portion 44 has an aperture for slidably receiving the bar 12 therethrough. The leg portion 46 includes an aperture 47 to slidably receive therethrough bar 12, presser member 24 and looper member 22 (see FIG. 5).

Looper member 22 is elongated metal member, preferably constructed of spring steel, and is resilient. Its rear end 22*a* is fixed to the web portion 48 of the shuttle member by suitable fastener means, such as screw 50. The front end 22*b* of the looper is slidably received in passageway 40 of the needle member 16.

The presser member 24 is made to be adjusted relative to the elongated bar 12 as well as to the shuttle member 20. A coupling member 52, in the form of an elongated U-shaped channel extending between the leg portions 44 and 46, surrounds the end portion 24*a* of the presser member 24 and an intermediate portion of the bar 12. A releasable fastener, such as screw 54, threadedly engages the end portion 24*a* of the presser and its shank portion end is sufficiently long so that its threaded end may protrude presser 24 and be received in slot 30 of the bar 12. Tightening screw 54 causes contacting engagement of a washer 58 with the inwardly projecting surfaces 58 and 60 of the U-shaped coupling member 52 (see FIG. 4). Therefore, the adjustment of the distance between the fabric-contacting portion 24*b* of the presser member and the shuttle member 20 consists in loosening fastener 54 to release the tight engagement between the washer 56 and surfaces 58 and 60 of the coupling member and in manually displacing the presser member 24 in the longitudinal plane of the bar. Once the adjustment is set, fastener 54 is tightened to from one movable unit that includes the shuttle member 20 (which also carries the looper member 22), the presser member 24 and the coupling member 52.

The reciprocating movement of the shuttle member on the bar 12 may be limited by having the rear leg portion 44 contacting the handle 14 and the front leg portion contacting the rear edges of the open-ended enclosure 16 or by having the treaded end of the fastener 54 contacting the opposite extremities 30*a* and 30*b* of the slot 30.

The reciprocating motion of the handle 14 with respect to the shuttle member 20 is a routine operation and more suitably carried out by powered drive means rather than manually. This can be accomplished for example, by an electric motor 100, which may be fitted with an internal reduction gearing, having a drive shaft 102, which is rigidly attached to a balanced and rotatable counterweight 104. The shaft 102 is freely rotatably in a rectangularly-shaped shaft receiving member 106, the latter being freely able to slide within the slot 30. Crankshafts 108 and 110 are freely pivotable eccentrically at their respective extremities on the electric motor 100 and the counterweight 104, and pivotable on their other respective ends on the bracket 120 attached to shuttle member 20 and the handle 14.

The dual crankshaft arrangement, according to the present invention, permits a greater stroke length of reciprocating motion of the handle 14 with respect to the shuttle member 20 than would be the case for a single crankshaft only. This is due to crankpins 112 and 114 attached to the electric motor 100 and the counterweight 104, respectively, being located at respective opposite ends as viewed in a plan view projection of the electric motor 112, as can, for example, be clearly seen in FIG. 3. When the shaft 102 of the electric motor 112 is rotating, it will cause the crankshaft 110 to move the handle 14 and the shuttle member 20 towards and away therefrom while the shaft-receiving member 106 simultaneously moves longitudinally within the slot 30 of the bar 12. It is the function of the shaft-receiving member 106 to isolate the rotating motion of the shaft 102 from the sliding up and down motion of the shaft-receiving member 106 within the slot 30 of the bar 12, so that any torque exerted on the shaft-receiving member 106 does not prevent the rotation of the shaft 102 therein, but still permits the sliding motion of the shaft-receiving member 106 within the bar 12.

At the expense of reducing the stroke length of the reciprocating motion of the handle 14 with respect to the shuttle member 20 it is, of course, feasible to disable, i.e. disconnect or remove either crankshaft 108 from the electric motor 112, or crankshaft 110 from the counterweight 104. The remaining connected crankshaft will still, upon rotation of the electric motor 100, execute a reciprocating motion, provided the shaft-receiving member 106 is rigidly attached to the rod 30 by means of, for example, a fastening member 116.

Sliding of the shaft-receiving member 106 within the slot 30 may be facilitated by means of ballbearings 118 operatively interposed between the respective sliding surfaces of the shaft-receiving member 106 and the slot 30 formed in the bar 12.

The powered drive means, e.g., at least the motor 100 and the crankshaft 108, can be surrounded for protection of the operator by an elastic protective cover 122, shown partly broken away in FIGS. 1 and 3, which may, for example, be made of rubber. It is preferably attached to the handle 14 and the shuttle member 20.

OPERATION OF THE INVENTION

First, the hooking needle is set for a desired loop length of material in the fabric base. This is accomplished by adjusting the position of the fabric-contacting portion 24*b* of the presser member relative to extremity 22*c* of the looper member 22; the greater the distance separating portion 24*b* from extremity 22*c*, the longer would be the loop of material formed in the fabric base since the penetration of the looper member would be greater. Once this adjustment is made, screw 54 is tightly fastened causing surfaces 58 and 60 of coupling member 52 to be squeezed between washer 56 and end 24*a* of the presser thereby preventing further movement between the presser 24 and the shuttle member 20 and allowing these members to move together during the reciprocating movements. Yarn is introduced in the yarn-receiving passage 38 of the needle member 16. The needle member 16 is positioned vertically over the undersurface of a fabric base and the electric motor 100 is turned on, causing the pointed end 42 of the needle to be forced through the fabric until the front edges of the sidewalls 32 and 34 of the open-ended enclosure. Further operation of the motor 100 causes the shuttle member 20 to be pushed downwardly thus engaging the yarn and holding it into a loop while the pointed end 42 of the needle is simultaneously retracted upwardly from the fabric until the leg portion 46 of the shuttle member contacts the needle member 16, or in cases, where the extremities of the slot 30 act as stoppers, until screw 54 engages the extremity 30*b* of the slot. Further operation of the motor 100 will result in a repeat of this reciprocating movement so that the hooking operation will progress as desired.

Although my invention has been described above in relation to a specific form thereof, it is not intended to be limited by the specific form described, except by the terms of the appended claims.

I claim:

1. In a hooking needle including an elongated bar having a handle attached at one end thereof, a needle member fixed to the opposite forward end of the bar, the needle member defining an open-ended enclosure having a yarn-receiving passage and a looper-receiving passage extending longitudinally therethrough, the needle member including a fabric-penetrating portion frontwardly extending in the longitudinal axis of the bar, a shuttle member mounted to the bar for reciprocating movement thereon between the handle and the needle member, an elongated looper member having one end attached to the shuttle member and the opposite forward end slidably received in the looper-receiving passage of the needle member, a presser member slidably mounted on the elongated bar and extending longitudinally thereof, the presser member having a forward portion adapted to rest against the fabric to be hooked, means for adjusting the relative position of the presser member to the bar and to the shuttle member to thereby vary the relative position of the forward end of the presser member to the forward end of the looper member, a coupling member in abutting engagement with the presser member adjacent the rear end thereof, and releasably fastening means for fixing the coupling member to the rear portion of the presser member, the improvement comprising:

a shaft-receiving member formed with a circular opening and included within the bar;

a motor having a shaft attached thereto, said shaft passing through said opening in said shaft-receiving member and being rotatable therein;

at least one crankshaft having one end thereof eccentrically pivoted on said motor; and at least one bracket attached to said shuttle member, the other end of said crankshaft being pivoted on said bracket, whereby the shuttle member performs a reciprocating movement between the handle and the needle member upon rotation of said motor.

2. A hooking needle according to claim 1 wherein said shaft receiving member is rigidly attached to said bar.

3. A hooking needle according to claim 1, wherein said elongated bar is formed with an elongated slot disposed in an intermediate portion of the bar between the handle and the needle member, and wherein said shaft-receiving member is slidable within said elongated slot.

4. A hooking needle according to claim 3 further comprising a counterweight attached to said shaft, said motor and said counterweight being disposed on respective opposite side of said bar, and a second crankshaft having one end thereof eccentrically pivoted on said counterweight, the other end of said second crankshaft being pivoted on said handle.

5. A hooking needle according to claim 3 further comprising ball bearing means operatively interposed between said shaft-receiving member and said bar to facilitate the sliding of said shaft-receiving member within said slot.

6. A hooking needle according to claim 1 further comprising an elastic protective cover attached to the bar and to the handle surrounding at least said motor and said crankshaft.

* * * * *